US007926180B2

(12) United States Patent
McCrink et al.

(10) Patent No.: US 7,926,180 B2
(45) Date of Patent: Apr. 19, 2011

(54) METHOD FOR MANUFACTURING GAS AND LIQUID STORAGE TANKS

(76) Inventors: Edward J. McCrink, Escondido, CA (US); Danny Codd, Escondido, CA (US)

( * ) Notice: Subject to any disclaimer, the term of this patent is extended or adjusted under 35 U.S.C. 154(b) by 1201 days.

(21) Appl. No.: 11/542,970

(22) Filed: Oct. 4, 2006

(65) Prior Publication Data

US 2007/0045384 A1 Mar. 1, 2007

Related U.S. Application Data

(63) Continuation-in-part of application No. 11/519,331, filed on Sep. 11, 2006, now Pat. No. 7,475,478, which is a continuation-in-part of application No. 10/519,910, filed as application No. PCT/US02/20888 on Jul. 1, 2002, now abandoned.

(60) Provisional application No. 60/301,970, filed on Jun. 29, 2001, now abandoned.

(51) Int. Cl.
*B21D 53/88* (2006.01)

(52) U.S. Cl. ..... 29/897.2; 148/592; 148/593; 148/597; 148/606; 148/607; 420/38

(58) Field of Classification Search ..... 29/897.2; 148/606, 607, 608, 609, 592, 593, 594, 597; 420/38

See application file for complete search history.

(56) References Cited

U.S. PATENT DOCUMENTS

| | | | | |
|---|---|---|---|---|
| 3,807,715 A | | 4/1974 | Nelson | 266/5 F |
| 4,062,705 A | | 12/1977 | Gondo | 148/127 |
| 4,188,419 A | | 2/1980 | Detert | 427/287 |
| 4,413,039 A | | 11/1983 | Higuchi | 428/643 |
| 4,461,679 A | | 7/1984 | Higuchi | 204/27 |
| 4,966,751 A | | 10/1990 | Kaede | 420/34 |
| 5,178,693 A | * | 1/1993 | Miyakusu et al. | 148/580 |
| 5,323,265 A | | 6/1994 | Fujie | 359/507 |
| 5,370,751 A | | 12/1994 | von Hagen | 148/330 |
| 5,485,948 A | | 1/1996 | McCrink | 228/126 |

(Continued)

FOREIGN PATENT DOCUMENTS

JP 58153731 A * 9/1983

(Continued)

OTHER PUBLICATIONS

T.G. Gooch. Welding metallurgy of stainless steel. pp. 77-78.

(Continued)

*Primary Examiner* — Derris H Banks
*Assistant Examiner* — Azm Parvez
(74) *Attorney, Agent, or Firm* — David G. Duckworth; Russo & Duckworth, LLP

(57) ABSTRACT

A method for making gas and liquid storage tanks such as automotive fuel tanks includes providing two or more blanks of air hardenable martensitic stainless steel in the annealed condition. The steel blanks have a thickness in the range of 0.5-5.0 mm., and are formed utilizing stamping, forging, pressing, or roller forming techniques or the like into the form of a tank shell components. The shell components are hardened and assembled into a storage tank. The shell components are hardened by application of heat, preferably to between 950° C. and 1100° C. for standard air hardenable martensitic stainless steels. Thereafter, the automotive fuel tank is preferably cooled at a rate greater than 25° C. per minute to achieve a Rockwell C hardness of at least 39. The automotive fuel tank may undergo additional heat treating processes including high temperature or low temperature tempering processes which may incorporate electro-coating.

23 Claims, 9 Drawing Sheets

U.S. PATENT DOCUMENTS

| | | | | |
|---|---|---|---|---|
| 5,558,317 | A | 9/1996 | Nels | 267/156 |
| 5,770,832 | A | 6/1998 | Carnes | 219/109 |
| 5,871,140 | A | 2/1999 | McCrink | 228/132 |
| 6,235,407 | B1 | 5/2001 | Ogata | 428/626 |
| 6,410,165 | B1 | 6/2002 | Warren | 428/680 |
| 6,621,958 | B1 * | 9/2003 | Dueck et al. | 385/37 |
| 6,645,318 | B2 | 11/2003 | Takahashi | 148/325 |
| 6,673,472 | B2 | 1/2004 | Maki | 428/653 |
| 6,676,777 | B2 | 1/2004 | Kimura | 148/529 |
| 6,718,932 | B1 | 4/2004 | Cecur | 123/188.3 |
| 6,730,407 | B2 | 5/2004 | Mori | 428/425.8 |
| 6,786,981 | B2 | 9/2004 | Yazawa | 148/325 |
| 6,814,820 | B2 | 11/2004 | Ozbaysal | 148/671 |
| 6,905,041 | B1 | 6/2005 | Taketsu | 220/562 |
| 6,935,529 | B2 | 8/2005 | Ishikawa | 220/562 |
| 2001/0030004 | A1 | 10/2001 | Kushda | 148/325 |
| 2002/0109024 | A1 | 8/2002 | Molnar | 239/585.1 |
| 2002/0138982 | A1 * | 10/2002 | Rhodes et al. | 29/890.054 |
| 2003/0025341 | A1 | 2/2003 | Kollaritsch | 293/102 |
| 2003/0138342 | A1 | 7/2003 | Hirasawa | 420/38 |
| 2004/0234715 | A1 | 11/2004 | Gandy | 428/36.9 |
| 2004/0262930 | A1 | 12/2004 | Cumming | 293/120 |
| 2006/0113011 | A1 | 6/2006 | Tanida | 148/592 |
| 2006/0130940 | A1 | 6/2006 | Kollaritsch | 148/518 |

FOREIGN PATENT DOCUMENTS

| | | |
|---|---|---|
| JP | 04-191319 | 9/1992 |
| JP | 2002137086 | 5/2002 |
| JP | 2002 301577 | 10/2002 |
| JP | 2003226917 A * | 8/2003 |
| WO | PCT/US2002/020888 | 7/2002 |

OTHER PUBLICATIONS

J. Gordon Parr. An introduction to Stainless Steel. 1965.

Allegheny Ludlum Steel Corp. (Stainless Steel Handbook).

Claud Bagger, et al. Induction het treatment of laser welds. vol. 15, No. 4. Nov. 2003.

N. Irvine Saz. Hawley's Condensed Chemical Dictionary. 11th Edition.

Naoshi Ayukawa, et al. Development of weldable martensitic stainless steel line pipe by HF-ERW process. Stainless Steel World 1999.

* cited by examiner

METHOD FOR MANUFACTURING GAS AND LIQUID STORAGE TANKS

RELATED APPLICATIONS

This application is a continuation-in-part application of U.S. application Ser. No. 11/519,331 filed on Sep. 11, 2006, now U.S. Pat. No. 7,475,478 which is in turn a continuation-in-part application of U.S. application Ser. No. 10/519,910 filed on Dec. 30, 2004, now abandoned which is in turn, a National Phase application of International Application Ser. No. PCT/US02/20888 filed on Jul. 1, 2002, which in turn, claims priority to U.S. Provisional Application No. 60/301,970 filed on Jun. 29, 2001.

BACKGROUND OF THE INVENTION

The present invention relates to tanks for storing gases and liquids. More particularly, the present invention relates to a method of manufacturing fuel tanks for automobiles and trucks.

It is preferred that automotive fuel tanks be lightweight, and of a sufficient strength and durability to meet automotive safety requirements. In addition, automotive fuel tanks must be able to contend with harsh environmental conditions, and thus must be corrosion resistant.

The fuel tank of an automobile is usually designed in accordance with the design of the body in the final stage, and the shape has tended to become more and more complicated in recent years. Thus, the fuel tank material should have an excellent deep drawability and not crack subsequent to forming. In addition, it is important that the material not corrode so as to lead to pitting corrosion and filter clogging. The material must also be easily and stably welded.

In cost-sensitive applications such as automotive fuel tanks, conventional engineering materials force a trade-off between cost and fuel efficiency, safety, and performance. Simply, a lightweight weak fuel tank compromises the durability of the tank and the safety of the vehicle occupants while a heavy strong fuel tank compromises the cost and fuel efficiency of the vehicle. As graphically depicted in FIG. 1, structural materials are currently available in a broad range of strength-to-weight ratios, or specific strengths, but the costs of these materials generally increase disproportionately to their specific strengths. Carbon composites and titanium, for example, while being perhaps ten times stronger than mild steel for a given weight, are typically more than fifty times more expensive. Consequently, such high performance materials are typically used only in on small items or in applications where the high cost is justified, such as in aircraft.

Automobile fuel tanks have generally been manufactured by plating surfaces of a soft steel sheet with a lead alloy and shaping and welding the coated steel sheet. A Pb—Sn alloy-plated steel sheet, which is called a terne steel sheet, has been used for fuel tanks. The steel sheet has chemical properties stabilized against gasoline, and shows excellent press formability due to the excellent lubricity of the plating. In addition to the Pb—Sn alloy-plated steel sheet, a Zn-plated steel sheet which is thickly chromated has also been used. The steel sheet also has excellent formability and corrosion resistance though not as good as the Pb—Sn alloy-plated steel sheet. However, a material not using Pb is desired from the standpoint of decreasing environmental pollution.

One of the prospective fuel tank materials of automobiles in which Pb is not used is an aluminum (Al—Si) plated steel sheet. Since aluminum forms a stabilized oxidized film on its surface, aluminum provides excellent resistance to corrosion caused by organic acids formed by the deterioration of alcohol, gasoline, etc. However, there are several problems with using the aluminum plated steel sheet as a fuel tank material. Since the aluminum plated steel sheet has a very hard Fe—Al—Si intermetallic compound layer formed at the interface between the plating layer and the steel sheet, the Al-plated steel sheet tends to crack when formed. The aluminum plated steel sheet also has the disadvantage that the peeling of the plating and crack formation tend to take place from a starting point in the alloy layer. When cracks are formed in the plating, corrosion tends to proceed from the cracks, and pitting may result in a short period of time. Accordingly, corrosion resistance subsequent to forming is a serious problem. Another problem is weldability. Although an aluminum plated steel sheet may be resistance welded, the welding lacks stability to some degree.

A stainless steel sheet is a fuel tank material capable of satisfying the requirement for higher corrosion resistance demanded from the standpoint of eliminating unacceptable corrosion. The use of austenitic stainless steels, which requires no lining treatments, has been attempted. Although the austenitic stainless steels exhibit superior processability and higher corrosion resistance compared with the ferritic stainless steels, the austenitic stainless steels are expensive for fuel tanks and have the possibility of stress corrosion cracking (SCC). Thus, the austenitic stainless steels have not yet been used in practice. In contrast, the ferritic stainless steels not containing nickel are advantageous in material costs compared with the austenitic stainless steels, but do not exhibit satisfactory corrosion resistance to so-called "deteriorated gasoline" containing organic acids, such as formic acid and acetic acid, which are formed in the ambient environment. Furthermore, the ferritic stainless steels do not exhibit sufficient processability to deep drawing for forming fuel tanks having complicated shapes.

As reflected in FIGS. 1 and 2, air hardenable martensitic stainless steels have exceptionally strength, particularly compared to common metals such as aluminum and even titanium. Nevertheless, such steels are relatively affordable. Air hardening steels have been commercially employed for use in cutlery for their high hardness. Common air hardenable steels include martensitic stainless steels. As defined herein, and as understood by those skilled in the art, air hardenable martensitic stainless steels are essentially alloys of chromium and carbon that possess a body-centered-cubic (bcc) or body-centered-tetragonal (bct) crystal (martensitic) structure in the hardened condition. They are ferromagnetic and hardenable by heat treatment, and they are generally mildly corrosion resistant.

Air hardenable martensitic stainless steels include a relatively high carbon and chromium content compared to other stainless steels with a carbon content between 0.08% by weight and 0.75% by weight and a chromium content between 11.5% by weight and 18% by weight. As reflected in FIG. 3, air hardenable martensitic stainless steels have also been defined, and are understood by those skilled in the art, as having a nickel equivalent of between about 4 and 12 and having a chromium equivalent of between about 8 and 15.5, where nickel equivalent is equal to (% Ni+30×% C)+(0.5×% Mn) and chromium equivalent is equal to (% Cr+% Mo+(1.5×% Si)+(0.5×% Nb). Either or both of these definitions are acceptable for practicing the present invention. According to these standard definitions, standard air hardenable martensitic stainless steels include types 403, 410, 414, 416, 416Se, 420, 420F, 422, 431, and 440A-C.

The relatively high carbon and chromium content compared to other stainless steels results in steel with good corrosion resistance, due to the protective chromium oxide layer that forms on the surface, and the ability to harden via heat treatment to a high strength condition. Unfortunately, the high carbon and chromium also presents difficulties related to brittleness and cracking in welding, and accordingly martensitic stainless steel has been primarily used for cutting tools, surgical instruments, valve seats, and shears. Non-stainless air hardenable steels, which contain very high levels of carbon to allow the formation of a martensitic microstructure upon quenching, also present difficulties related to brittleness and cracking. In fact, experimentation with air hardenable stainless steels for tank applications, and particularly automotive fuel tank applications, appears to have never been attempted due to the paradigm shift in thinking required to produce a high-strength automotive part. Historically, high-strength automotive applications relied on the evolutionary approach of forming a ferrous alloys strip, in its final metallurgical microstructure, using successively higher strength steels as the raw material until either the strength targets were met or the part could not be formed due to the material's limitations.

The use of air hardenable martensitic stainless steels for golf clubs and bicycle applications was introduced in U.S. Pat. Nos. 5,485,948 and further described in 5,871,140. These patents describe brazed tube structures that take advantage of the fact that air hardenable stainless steel can be simultaneously brazed and hardened in one heat treating operation. However, there is no suggestion as to how to use such a material for tanks for storing liquids or gases such as automotive fuel tanks.

Thus, rather than resort to the use of expensive alloys, it would be beneficial to create a process that could utilize a common inexpensive air hardenable stainless steel to produce storage tanks substantially free of cracks. Such a process would be even more beneficial if the material possessed the corrosion resistant properties of stainless steel.

Furthermore, it would be desirable for an improved method for manufacturing automotive fuel tanks which are built strong and lightweight, yet are produced at a low costs.

SUMMARY OF THE INVENTION

The present invention is directed to a method of manufacturing gas or liquid storage tanks using air-hardenable martensitic stainless steel. In a preferred embodiment, the present invention is directed to a method of manufacturing automotive fuel tanks using air-hardenable martensitic stainless steel. Preferred air-hardenable martensitic stainless steels include types 410, 420 and 440.

In accordance with the invention, the method of manufacturing a gas or liquid storage tank includes providing a plurality of blanks made of air-hardenable martensitic stainless steel in the annealed condition having a thickness in the range of 0.5-5.0 mm. For automotive fuel tank applications, preferably the martensitic stainless steel blanks are provided in a coil, strip or sheet form having a thickness of 0.8-2.0 mm. Of importance, the blanks are also provided in the annealed condition, prepared in accordance with annealing processes known to those skilled in the art. Thereafter, the martensitic stainless steel blanks are formed by a variety of traditional forming processes including stamping, forging, pressing, roller forming, etc. to form portions of the storage tank, referred to herein as "shell components". For forming shell components for producing an automotive fuel tank, the blanks are preferably formed into shell components using traditional stamping or hot stamping processes. Where hot stamping is employed, the shell components may be simultaneously hardened as explained in greater detail below.

After forming the two or more shell components, the shell components must be: 1) assembled into a storage tank, and 2) subjected to heat and air quenching in a hardening cycle. The assembly and hardening steps may be conducted in either order with the assembly or hardening occurring before the other.

To assemble the tank, the shell components are fastened together to form the desired storage tank construction. The shell components may be affixed together utilizing adhesives, mechanical fasteners, brazing, or welding processes such as using arc, resistance, laser or solid state welding methods among other methods as can be selected by those skilled in the art. Alternatively, the shell components may be welded together using the welding process described in parent application Ser. No. 11/143,848 which is incorporated herein in its entirety by reference. Briefly, this welding process includes welding adjoining surfaces of the shell components together, such as by using resistance welding or a gas tungsten arc welding process, commonly known as tungsten inert gas process (TIG) or gas tungsten arc welding (GTAW). Plasma arc welding or laser welding, or additional non-typical welding methods may also be employed. The weld zone temperature is then controlled using the secondary heat source which is preferably a torch assembly or induction coil assembly positioned adjacent to the weld immediately downstream of the weld box. The weld area is slow cooled at a rate slower than natural air cooling using the secondary heat source between the $A_3$ temperature, which is the upper critical temperature above which austenite is found, and the $A_1$ temperature, which is the lower critical temperature below which ferrite are carbide are stable. The cooling rate is dependent upon weld speed, wall thickness, alloy-type in ambient conditions. However, the secondary heat source provides heat at a sufficiently high temperature and maintains heat for sufficiently long so as to reduce the hardness of the weld.

After the steel blanks have been formed into shell components, the shell components undergo a hardening cycle to harden the annealed air hardenable martensitic stainless steel and to obtain a uniform, high strength condition throughout the completed tank assembly Again, the hardening cycle may be conducted prior or subsequent to the shell components being affixed together to form a storage tank. In addition, the hardening cycle may be conducted simultaneously during the forming of the shell components where the shell components are formed by hot stamping. The hardening cycle includes heating and air cooling the automotive shell components. Traditional air hardenable martensitic stainless steels, including types 410, 420 and 440, are hardened by heat treatment at between 950° C. and 1100° C. Thus, it is preferred that the shell components be heated to between 950° C. and 1100° C. Moreover, it is anticipated that air hardenable martensitic stainless steels may be developed by those skilled in the art without undue experimentation which, as a result of additional alloys, can be heat treated at a broader range of temperatures such as 925° C. and 1200° C. During the heating process, preferably the shell components are maintained at a sufficiently high temperature for a sufficiently long period so as to austenitize the shell components' entire microstructure.

The hardening cycle of the present invention further requires that the shell components be air quenched at a sufficiently rapid rate so as to transform the steel into a predominantly martensitic microstructure. Ideally, the air quenching is conducted sufficiently quickly as to transform the predominantly austenitic steel into a 90-100% martensitic microstructure and 0-10% ferrite microstructure. This air cooling process must be done at a rate greater than 15° C. per minute for air-hardenable martensitic stainless steels and anticipated air hardenable stainless steel alloys. It is also aspect of the present invention that the hardening cycle hardens the shell components to a Rockwell C hardness of at least 39. To obtain a Rockwell C hardness of 39 or greater, air cooling of the shell components are preferably conducted at a rate greater than 25° C. per minute for standard martensitic stainless steels including types 410, 420 and 440.

Subsequent to hardening and assembling the shell components into a storage tank, the shell components may be capable of being used without further heat treatment. However, where improved ductility is desired, preferably the hardened shell components are subjected to a tempering process. Various tempering processes may be conducted as can be selected as those skilled in the art. In a preferred high temperature tempering process, the shell components are heated to between 150° C. and 650° C. In a preferred low temperature tempering process, the shell components are heated to between 130° C. and 180° C. This low temperature tempering process may be conducted simultaneously during an electrocoating process in which the shell components are typically heating to between 130° C. and 180° C. for 20-30 minutes. Subsequent to heating, the shell components are air quenched which results in the automotive fuel tank having a reduced brittleness and corresponding increased toughness and ductility, without a substantial loss in hardness or strength.

In preferred embodiments of the invention, after the tank shell components have been formed, selected sub-components such as pumps, fuel fenders, sensors and baffles may affixed to the shell components. The sub-components may be affixed using adhesives, brazing, welding or mechanical fasteners. Moreover, the sub-components may be affixed to the shell components at various stages during the fabrication process. The sub-components can be affixed to the shell components prior to hardening of the martensitic steel. However, since many sub-components would be adversely affected by the high temperatures experienced during the hardening process, it is preferred that the sub-components be affixed to the shell components after hardening.

Where the shell components are hardened prior to assembly into a tank structure, the sub-components may be affixed to the shell components either immediately after hardening, prior to assembling the shell components together, or after the shell components have been assembled to form a tank structure. Where a high temperature tempering process is practiced, it is preferred that temperature sensitive sub-components be affixed to the shell components after the shell components have been tempered.

Advantageously, the manufactured storage tank has high strength, desirable toughness and ductility, and substantial corrosion resistance. Moreover, air-hardenable martensitic stainless steels are relatively inexpensive compared to many other steel alloys or composite materials which results in automotive fuel tanks having improved functional properties at a reduced cost.

It is thus an object of the present invention to provide a high strength low cost process for manufacturing, storage tanks and particularly automotive fuel tanks.

Other features and advantages of the present invention will be appreciated by those skilled in the art upon reading the detailed description which follows with reference to the attached drawings.

DETAILED DESCRIPTION OF THE INVENTION

Figure 1:
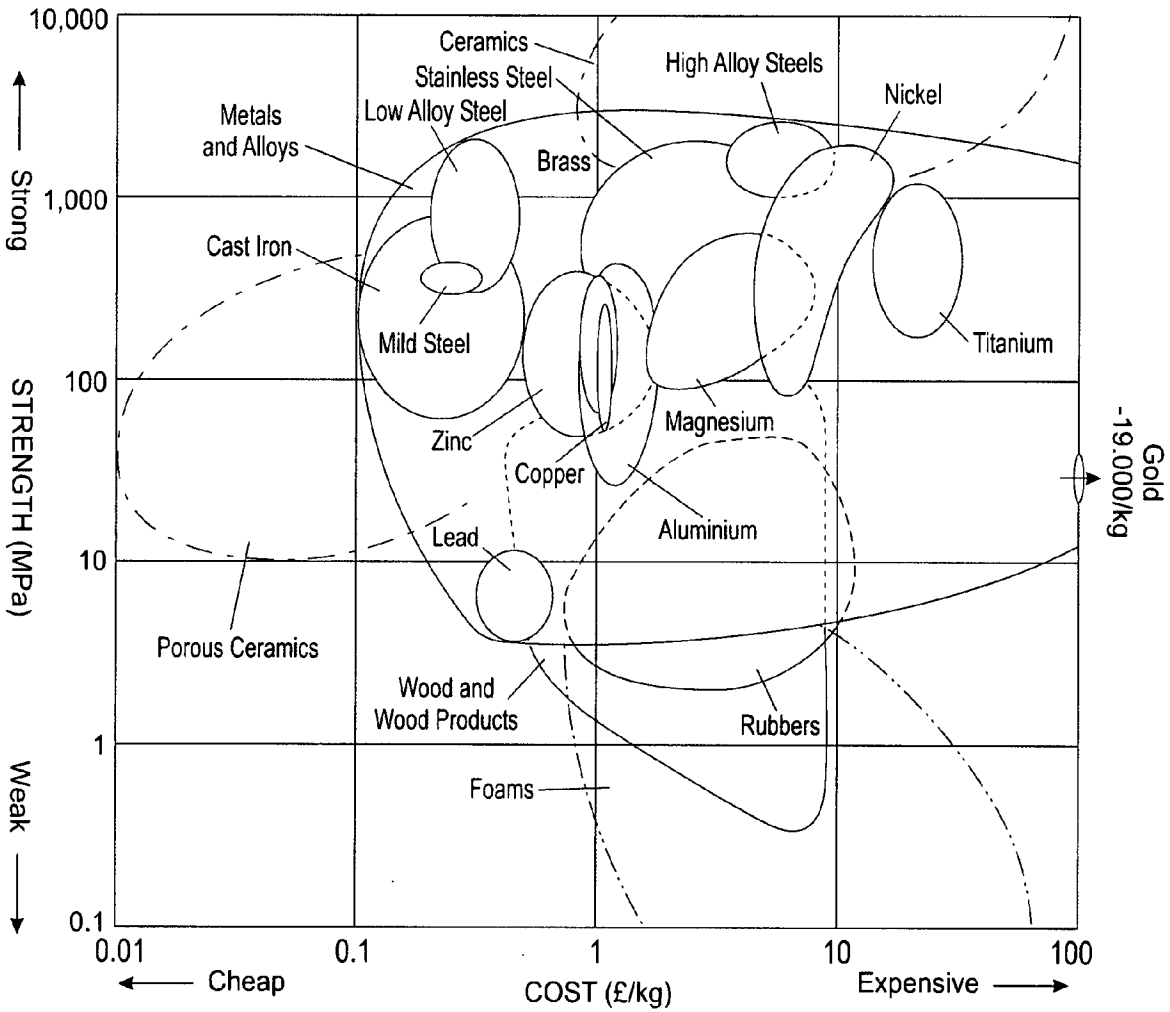
FIG. 1 is a chart illustrating relative strength/cost advantages of various materials.
Figure 2:
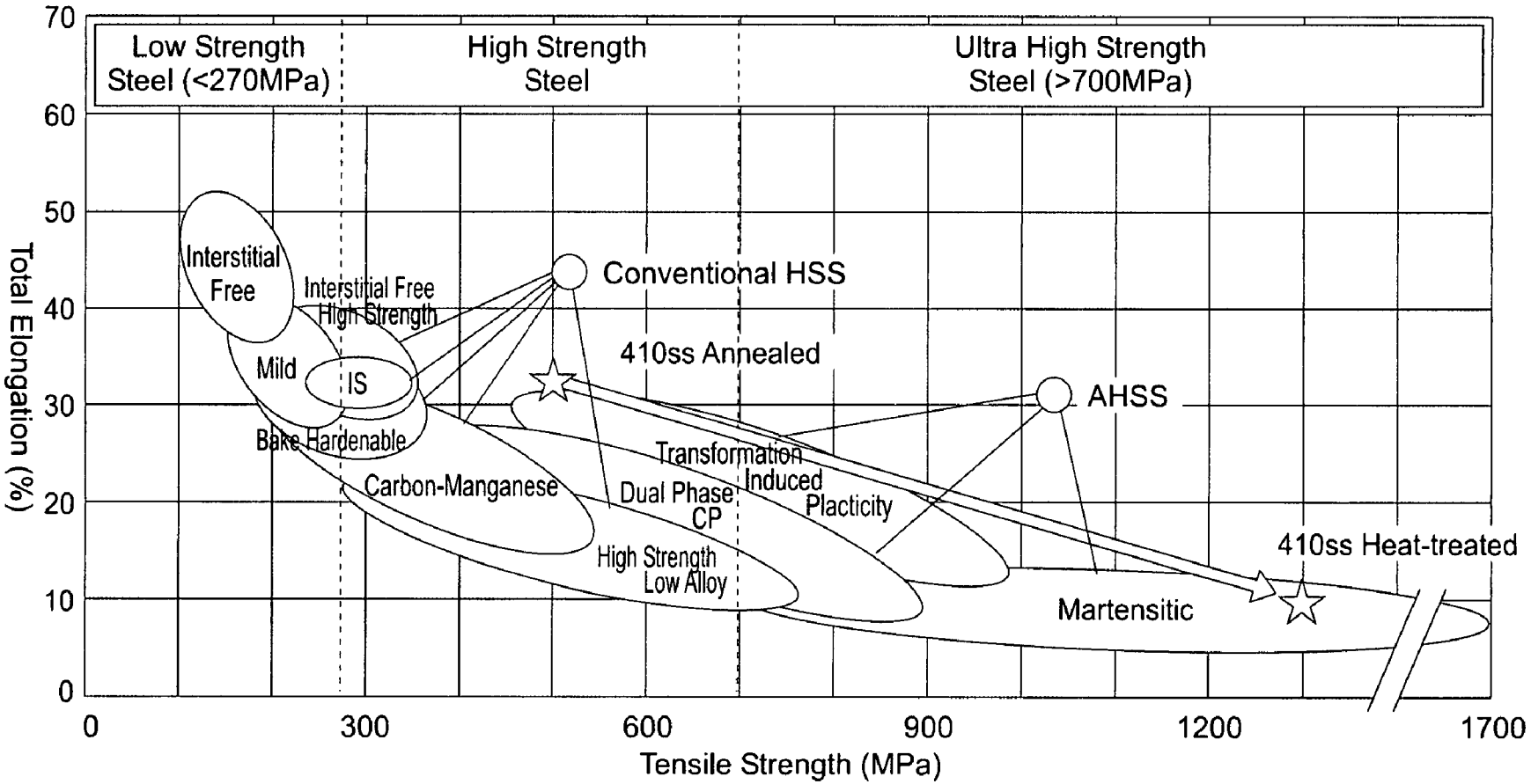
FIG. 2 is a chart illustrating relative strength advantages of various materials including martensitic stainless steel.
Figure 3:
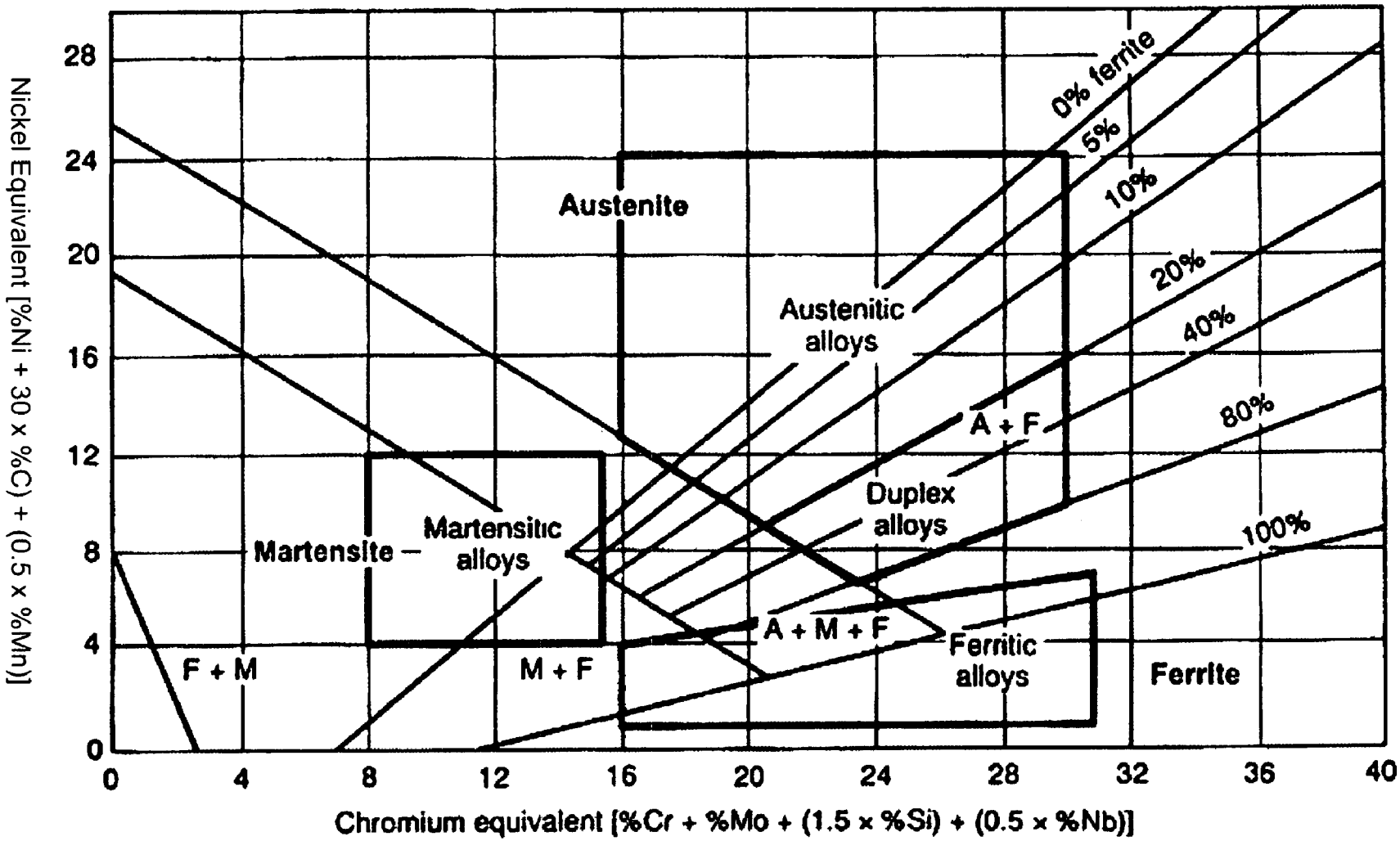
FIG. 3 is a chart illustrating a definition for martensitic stainless steel in terms of chromium equivalent and nickel equivalent.

While the present invention is susceptible of embodiment in its various forms, there is shown in the drawings and will be hereinafter be described the presently preferred embodiments of the invention with the understanding that the present disclosure is to be considered as exemplifications of the invention and it is not intended to limit the invention to the specific embodiments illustrated.

As illustrated in FIGS. 4-8, the present invention is directed to a method of manufacturing tanks for storing gases and liquids. Because the method of manufacturing tanks is particularly useful for producing automotive fuel tanks, the invention will hereinafter be described for fabricating an automotive fuel tank. However, the present invention is not intended to be unduly limited to producing automotive fuel tanks, and indeed, the invention may be utilized to produce a wide variety of gas or liquid storage tanks including but not limited to scuba tanks, propane tanks, vehicle and railroad transportation tanks, septic tanks, etc., etc.

Figure 7:
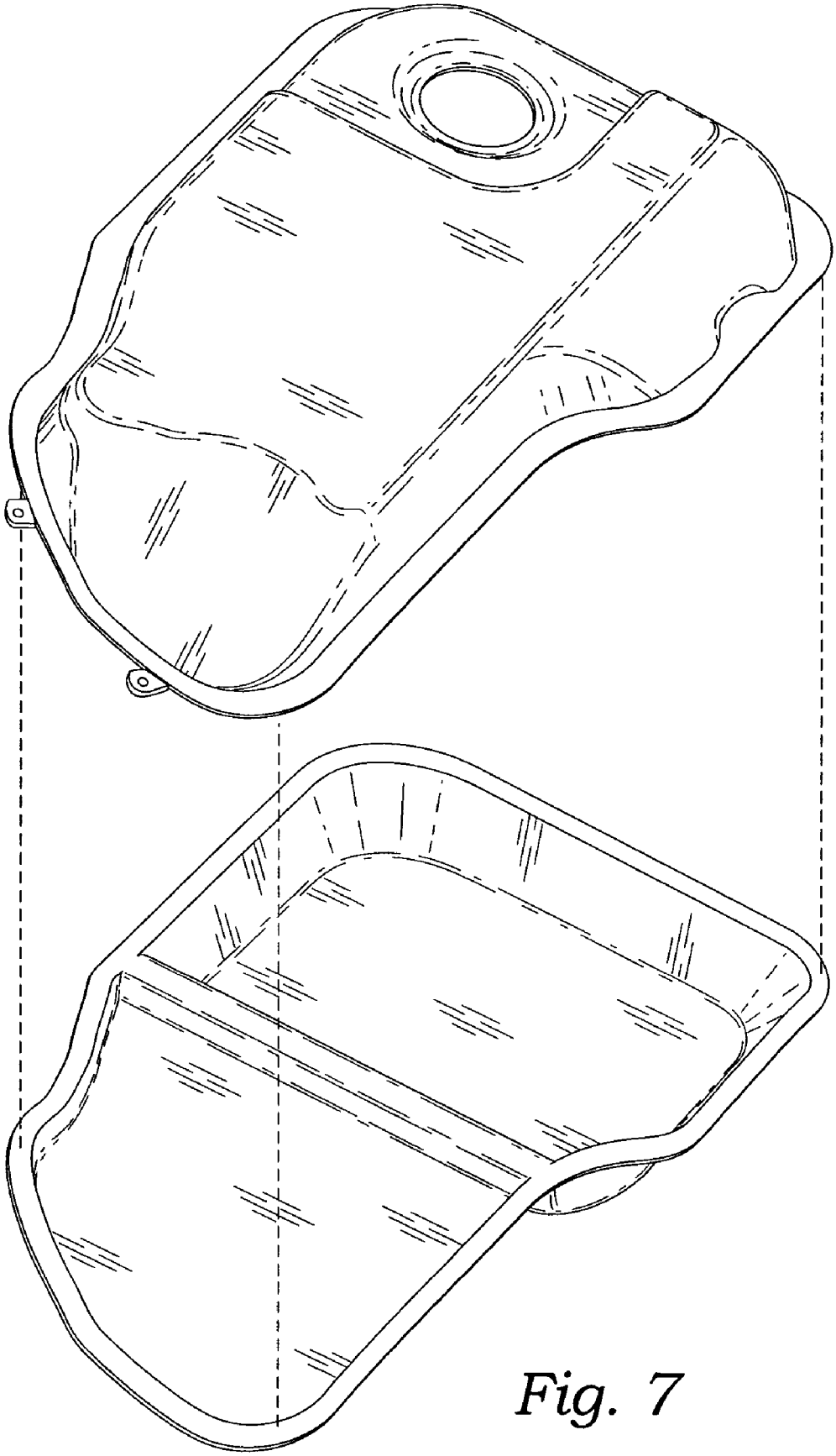
FIG. 7 is an exploded perspective view illustrating two shell components for forming a vehicle fuel tank.

In accordance with the invention, air hardenable martensitic stainless steel, preferably of types 410, 420 or 440, is provided in coil, strip or sheet form to provide two or more blanks having a thickness of 0.5-5.0 mm. The invention is described herein using two blanks for producing a storage tank. However, three or even many more blanks may be used to fabricate the tank structure depending on the tank shape's complexity. With reference to FIG. 7, preferably, for producing an automotive fuel tank, two blanks are provided in sheet form having a thickness in the range of 0.8-2.0 mm. The blanks are annealed, or provided in the annealed form, so as to have a microstructure consisting primarily of ferrite and chromium carbide compounds. Annealing of the martensitic steel results in a reduced hardness. For example, annealing type 410 martensitic stainless steel typically produces blanks having a Rockwell B hardness of 82, an elongation of 34%, a 0.2% yield strength of 290 mega pascals (MPa), and a tensile strength of 510 MPa.

Figure 4:
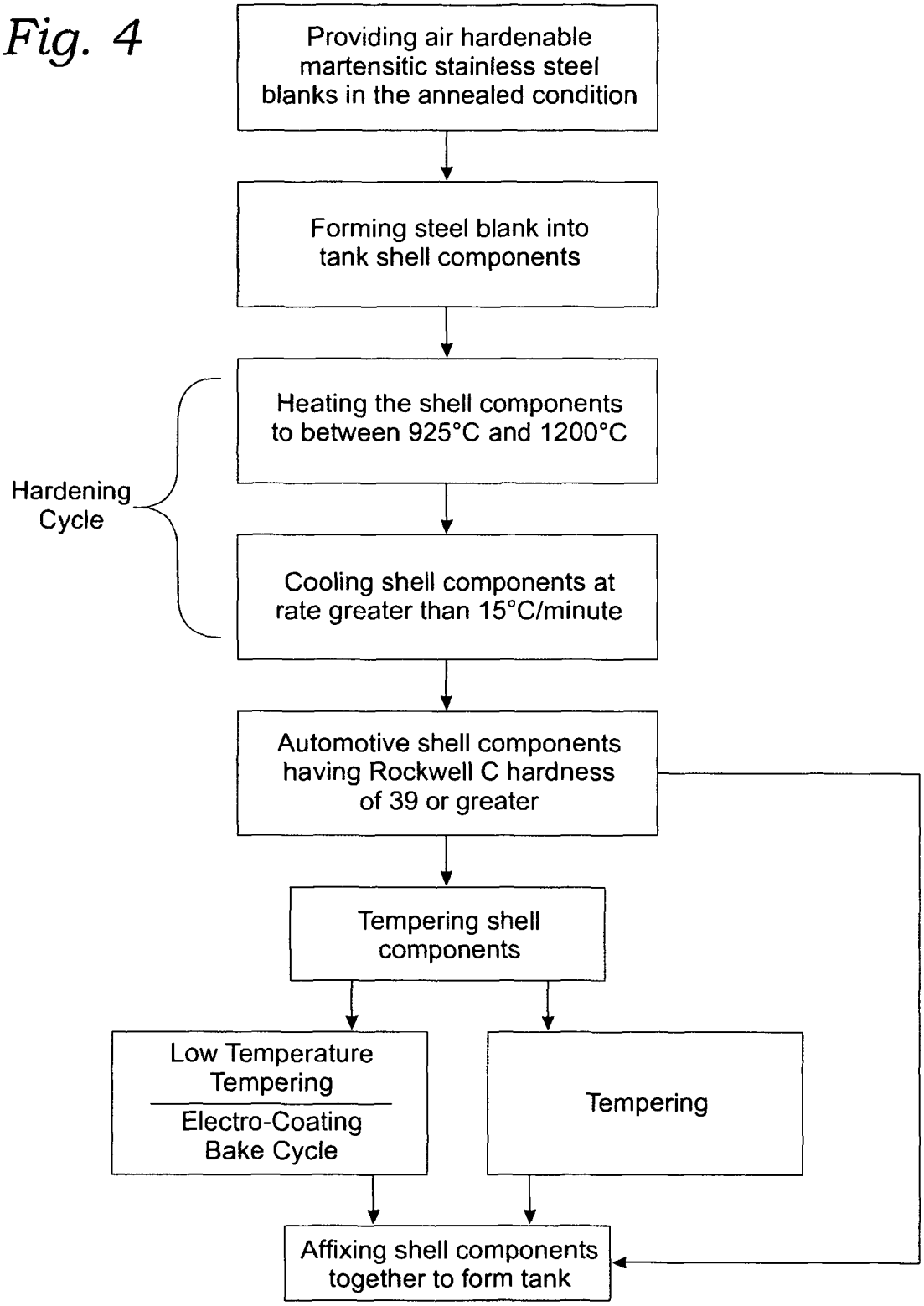
FIG. 4 is a flow chart illustrating the manufacturing process of the present invention for producing gas and liquid storage tanks.
Figure 5:
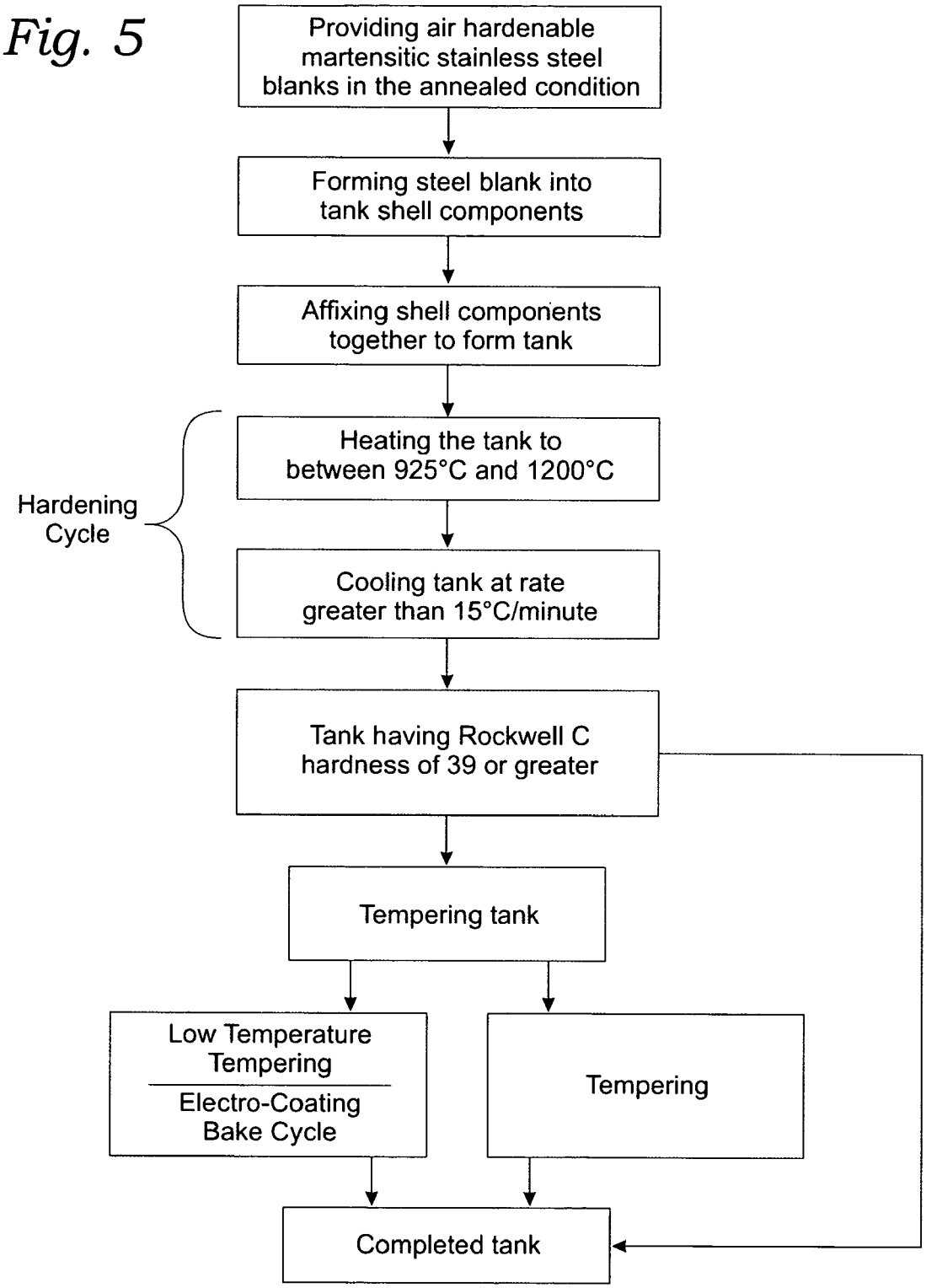
FIG. 5 is a alternative flow chart illustrating the manufacturing process of the present invention for producing gas and liquid storage tanks.

With reference to FIGS. 4 and 5, the annealed martensitic stainless steel blanks are formed by conventional metal processing techniques including stamping, pressing, forging, roller forming, etc. to form shell components which can take a variety of shapes. After forming, the shell components are hardened and affixed together to form a fuel tank assembly. As reflected in FIG. 4, the step of hardening the shell components may be conducted prior to assembly of the fuel tank, or as reflected in FIG. 5, the shell components may be affixed together to form the fuel tank structure prior to hardening the air hardenable martensitic stainless steel.

The fastening techniques for affixing the shell components together may include simple mechanical fasteners such as the use of nuts and bolts, shear pins, or bracketry. Additionally, brazing and welding such as arc, resistance, laser, plasma or solid state welding methods may be used to join shell components to create the vehicle fuel tanks. If welding is employed, care must be taken to not overly stress the weld and associated heat-affected-zones (HAZ) during handling as local hardening and brittleness may occur depending on the weld method and heat input employed.

Figure 9:
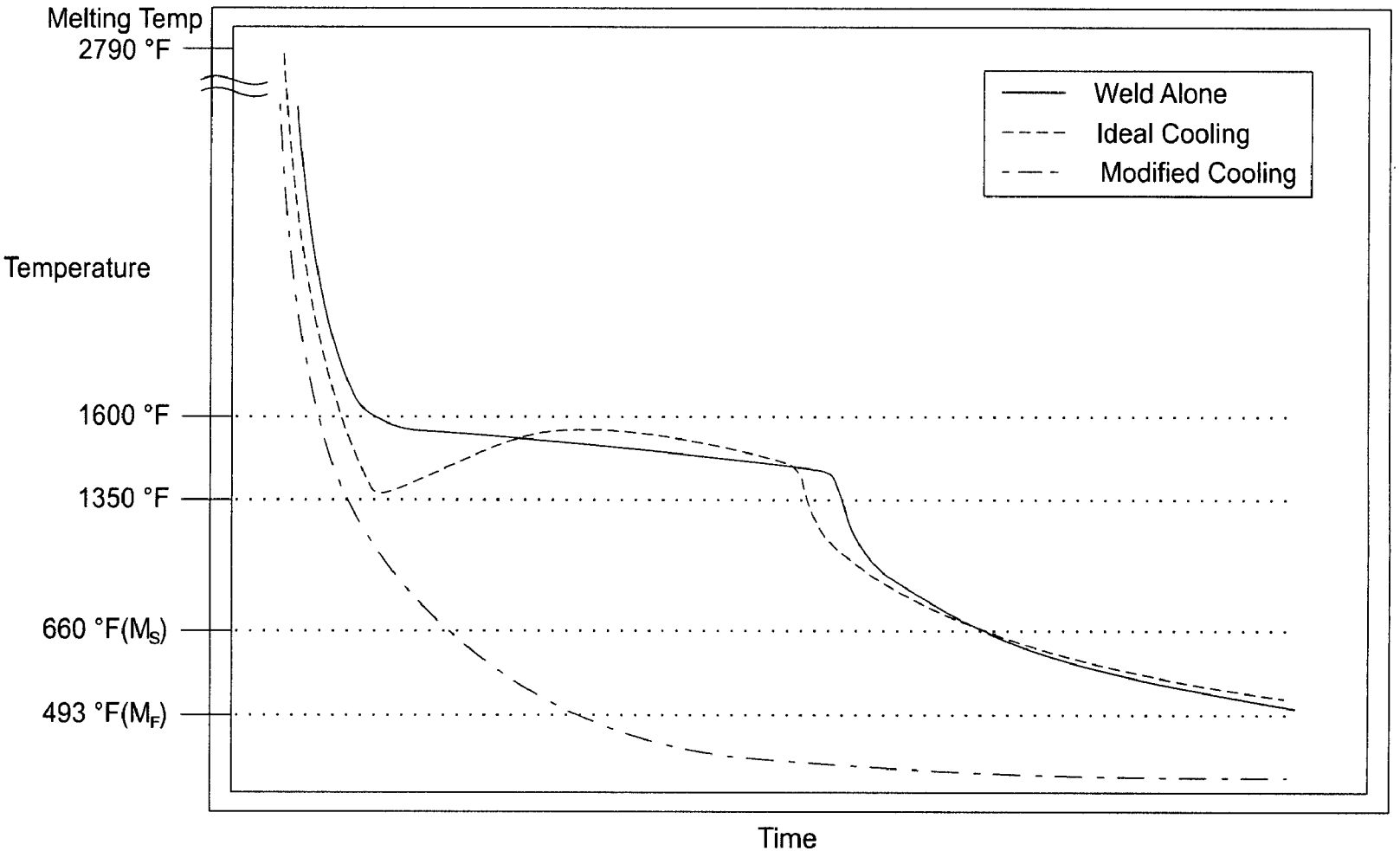
FIG. 9 is a chart illustrating the cooling profile using a preferred welding process.

In an effort to reduce the local hardening and brittleness in the weld zone, a secondary heat source may be utilized to apply heat locally to the welded metal immediately after the welding process. For this embodiment of the invention, heat may be applied to the weld area using any of a variety of localized heat sources including propane or oxyacetylene torches, or induction coils to provide heat to the weld, but not to the entire automotive structural component, such as provided by a furnace or oven. Preferably, as illustrated in FIG. 9, the heat from the secondary heat source is applied to the weld zone prior to the weld cooling below the lower critical temperature for air hardenable martensitic stainless steel. This heat is applied for a sufficiently long period and at a sufficiently high temperature so as to maintain the weld between the A3 temperature and the A1 temperature to thereby reduce the hardness of the weld. This slow cooling results in a temperature reduction which is much slower than natural air cooling, and is a reduction rate which is dependent upon a variety of factors including the material thicknesses, alloy type and ambient conditions.

As illustrated in FIGS. 4 and 5, subsequent to forming the shell components, the shell components proceed through a two-step hardening cycle in order to obtain a uniform, high strength condition throughout the entire part. The hardening process is intended to provide a Rockwell C hardness of at least 39. To this end, the individual shell components (see FIG. 4) or assembled automotive fuel tank (see FIG. 5) are first heated to between 925° C. and 1200° C. depending on the chemical composition of the air hardenable martensitic stainless steel. More preferably, for standard air hardenable stainless steels such as 410, 420 and 440, the shell components or assembled fuel tank are heated until their entire structures has a temperature between 950° C. and 1100° C., resulting in a microstructure which is substantially austenitic. This heating of the air hardenable stainless steel may also be conducted simultaneously during the step of forming the blank into a shell component such as during a hot stamping process.

Ideally, the parts are heated using high-throughput continuous furnaces producing heat through gas, electric or induction heating apparatus. Furthermore, the furnaces preferably employ a roller hearth or continuous mesh belt which introduces a protective atmosphere of nitrogen, argon, hydrogen or disassociated ammonia to prevent oxidation of the automotive fuel tanks. The term "protective atmosphere" as used herein may also describe other non-oxidizing atmospheres including vacuum furnaces. Temperatures will vary depending on the type of air hardenable martensitic stainless steel. As an example, for type 410 martensitic stainless steel, the entire part should be heated slightly above the steel's upper critical temperature to a range of 950° C. to 1100° C.

The second phase of the hardening cycle entails air quenching the shell components (see FIG. 4) or assembled automotive fuel tank (see FIG. 5) at a rate so as to transform the predominantly austenitic steel into a predominantly martensitic microstructure. As defined herein, the term "air cooling" and "air quenching" is intended to be interpreted broadly so as to include the implementation of protective atmospheres within the furnace including nitrogen, argon and disassociated ammonia, but to not include liquid quenching. Ideally, the air quenching is conducted sufficiently quickly so as to transform the steel into a 90-100% martensitic microstructure and a 0-10% ferritic microstructure. This air cooling process must be conducted at a rate greater than 15° C. per minute for typical air hardenable martensitic stainless steels and not-yet-developed air hardenable martensitic stainless steel alloys which may include chemical compositions permitting a relatively slow cooling rate. However, for standard air hardenable stainless steels such as 410, 420, and 440, preferably the air cooling process is conducted at the much faster rate of 25° C. per minute or greater. The cooling zone preferably includes water jackets to remove excess heat while a protective atmospheric gas circulates in the chamber to cool the automotive fuel tank.

Figure 6:
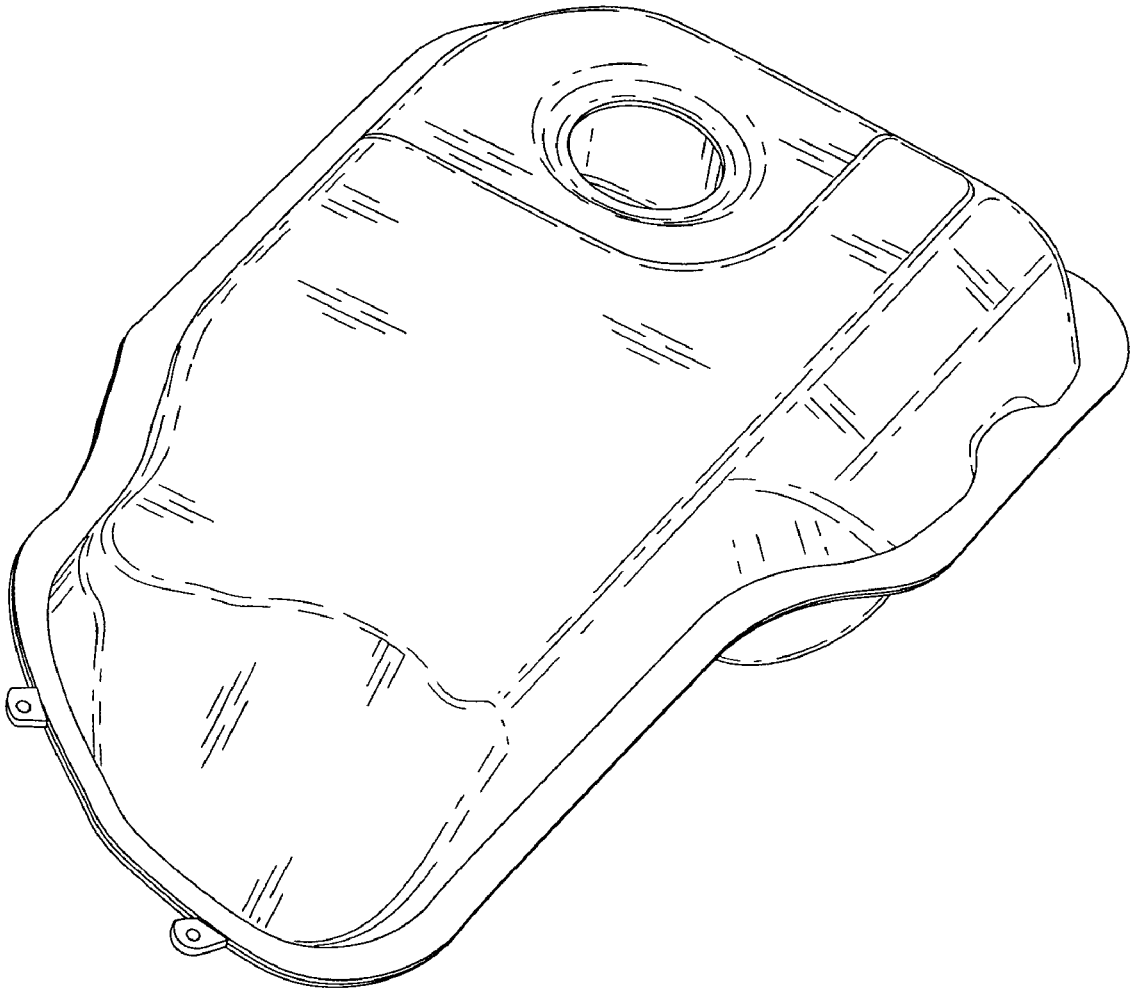
FIG. 6 is a perspective view illustrating a vehicle fuel tank of the present invention.
Figure 8:
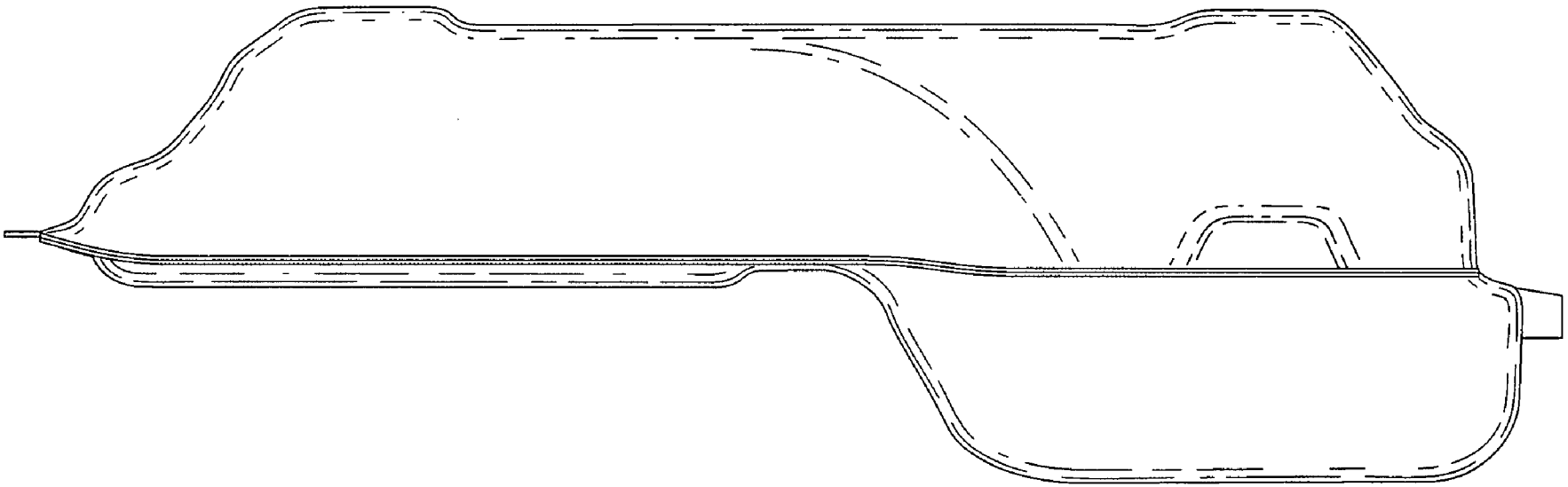
FIG. 8 is a side view illustrating a vehicle fuel tank of the present invention.

As first example, and with reference to FIGS. 5, 6 and 8, a plurality of blanks of annealed type 410 martensitic stainless steel are formed into fuel tank shell components. The shell components are then assembled into automotive fuel tank and hardened. The fuel tank steel is hardened by first heating the assembled fuel tank to between 950° C. to 1100° C. and then air cooling the part at greater than 25° C. per minute. After air quenching, the automotive fuel tank of type 410 martensitic stainless steel exists in a fully hardened condition having a Rockwell C hardness of 40-44 and having a corresponding tensile strength of 1200-1500 MPa.

In an alternative example, and with reference to FIGS. 4 and 7, a plurality of blanks of annealed type 410 martensitic stainless steel are formed into fuel tank shell components. The shell components then hardened by first heating them to between 950° C. to 1100° C. and then air cooling them at greater than 25° C. per minute. After air quenching, the shell components are assembled to form an automotive fuel tank. Like the previous example, the automotive fuel tank of type 410 martensitic stainless steel exists in a fully hardened condition having a Rockwell C hardness of 40-44 and having a corresponding tensile strength of 1200-1500 MPa.

As illustrated in FIGS. 4 and 5, the hardened automotive fuel tanks may be employed in a vehicle without further heat treatment where high strength is desired, and limited ductility and brittleness are not concerns. However, it is preferred that the automotive fuel tank be tempered, either through a high temperature tempering process or a low temperature tempering process prior to introduction of the part into an automotive vehicle. The tempering process may be performed on the shell components prior to assembling them into a fuel tank. However, where the shell components are welded together to form a fuel tank, it is preferred that the tempering process be conducted subsequent to assembly of the fuel tank in order to toughen (temper) the weld's heat-affected-zone (HAZ).

In a preferred high temperature tempering process, the shell components are heated to between 150° C. and 650° C. This subsequent heating of the part instills a substantial increase in ductility and corresponding decrease in brittleness. Subsequent to the tempering process, the shell components are allowed to air cool to ambient temperatures.

In an alternative tempering process, the shell components are subjected to a low temperature tempering in which the part is heated to between 130° C. and 180° C. Ideally, this low temperature tempering operation is conducted during an electro-coating process in which the part is baked at between 130° C. and 180° C. for 20-30 minutes and then air quenched. The low temperature tempering/electro-coating bake cycle also reduces the brittleness and increases toughness and ductility without a substantial loss in hardness.

Present day automotive fuel tanks are typically self contained and often include variety of sub-components positioned within the tanks' interior. For example, fuel pumps which were traditionally positioned within a vehicle's engine housing exterior to the fuel tank are now often placed within the fuel tank itself. Even where a vehicle fuel pump is positioned exterior to the fuel tank, present fuel tank designs will often include a "pre" fuel pump positioned within the fuel tank's interior for pumping fuel to the exterior main fuel pump. Fuel senders are also traditionally placed within an automotive fuel tank for measuring fuel level. Additionally, fuel tanks may include anti-sloshing baffles and one-way valves for releasing excess pressure buildup. Still additional sub-components may be introduced into fuel tanks. For example, future automotive fuel tanks, such as for storing hydrogen, may include temperature and pressure sensors mounted within the tanks' interior.

Thus, though not illustrated in the Figures, in preferred embodiments of the invention, selected sub-components such as pumps, fuel senders, baffles and sensors are affixed to the shell components. The sub-components may be affixed to the shell components by various methods known to those skilled in the art such as using adhesives, brazing, welding or mechanical fasteners. Moreover, the sub-components may be affixed to the shell components at various stages during the fabrication process. For example, the sub-components can be affixed to the shell components prior to hardening the martensitic stainless steel. However, since many sub-components would be adversely affected by the high temperatures experienced during the hardening process, it is preferred that the sub-components be affixed to the shell components after hardening.

Where the shell components are hardened prior to assembly into a tank structure, the sub-components may be affixed to the shell components either prior to assembling the shell components together or after the shell components have been assembled to form a tank structure. Where the sub-components are affixed to the shell components after assembly of the fuel tank, the sub-components are introduced into the tank's interior through an opening (see FIG. 6) in the tank's sidewall. The sub-components may also be affixed to the shell components prior or subsequent to any tempering of the martensitic steel, particularly where a low temperature tempering is conducted. For example, with reference to FIGS. 4 and 5, the sub-components may be affixed to the shell components after hardening, but prior to tempering of the shell components. Moreover, with reference to FIG. 4, the sub-components may be affixed to the shell components prior or subsequent to affixing the shell components together to form the fuel tank. In a preferred embodiment, the individual shell components or assembled fuel tank, and affixed sub-components, are subjected to a low temperature tempering such as during an electro-coating process. However, where a high temperature tempering process is practiced, it is preferred that temperature sensitive sub-components be affixed to the shell components after tempering.

While several particular forms of the invention have been illustrated and described, it will be apparent to those skilled in the art that various modifications can be made without departing from the spirit and scope of the invention. Accordingly, it is not intended that the invention be limited except by the following claims.

We claim:

1. A method of manufacturing a tank for storing gases or liquids comprising the steps of:

providing two or more air hardenable martensitic stainless steel blanks in the annealed condition, each having a thickness in the range of 0.5-5.0 millimeters;

stamping the stainless steel blanks while in the annealed condition to from a plurality of shell components;

hardening the shell components by heating the shell components to between 925° C. and 1200° C. and subsequently air cooling the shell components at a rate greater than 15° C./minute to harden the shell components to a Rockwell C hardness of at least 39; and affixing the shell components together to form a tank.

2. The method of manufacturing a tank of claim 1 wherein said steps of stamping and hardening the steel blanks are performed simultaneously in a hot stamping operation.

3. The method of manufacturing a tank of claim 1 wherein said step of hardening the shell components includes heating the shell components to between 950° C. and 1100° C. and subsequently air cooling the shell components at a rate greater than 25° C./minute.

4. The method of manufacturing a tank of claim 1 further comprising the steps of:

allowing the shell components to reach equilibrium after hardening;

tempering the shell components by heating the shell components to between 150° C. and 650° C.; and allowing the shell components to air cool after tempering to ambient temperatures.

5. The method of manufacturing a tank of claim 1 further comprising the steps of:

allowing the shell components to reach equilibrium after hardening;

performing a low temperature tempering of the shell components by heating the shell components to between 130° C. and 180° C.; and allowing the shell components to air cool after tempering to ambient temperatures.

6. The method of manufacturing a tank of claim 5 wherein the step of performing a low temperature tempering is accomplished during an electro-coating bake cycle.

7. The method of manufacturing a tank of claim 5 further comprising the step of affixing a sub-component to a shell component, said step of affixing a sub-component to a shell component being done prior to said step of performing a low temperature tempering of the shell components.

8. The method of manufacturing a tank of claim 5 wherein said step of performing a low temperature tempering is accomplished after said step of affixing the shell components together to form a tank.

9. The method of manufacturing a tank of claim 7 wherein the sub-component is selected from the group consisting of pumps, one-way valves, fuel level sensors, baffles, temperature sensors and pressure sensors.

10. The method of manufacturing a tank of claim 1 wherein the air hardenable martensitic stainless steel blanks are type 410 or type 420.

11. The method of manufacturing a tank of claim 1 wherein the air hardenable martensitic stainless steel blanks have a thickness of 0.8 to 2.0 mm. and the tank is an automotive fuel tank.

12. The method of manufacturing a tank of claim 1 wherein said step of affixing the shell components together to form a tank includes the steps of:

welding a first shell component to a second shell component by applying a first heat source to the first shell component and the second shell component at a sufficiently high temperature to bring surfaces of first shell component and the second shell component above their melting points to form a weld; and applying a second heat source at the weld immediately after the step of welding so as to be prior to the weld cooling below the lower critical temperature for the martensitic stainless steels, the second heat source being at a temperature lower than the first heat source but at a sufficiently high temperature and maintained for sufficient long time period so as to reduce the hardness of the weld.

13. A method of manufacturing a tank for storing gases or liquids comprising the steps of:

providing two or more air hardenable martensitic stainless steel blanks in the annealed condition, each having a thickness in the range of 0.5-5.0 millimeters;

stamping the stainless steel blanks while in the annealed condition to from a plurality of shell components;

hardening the shell components by heating the shell components to between 950° C. and 1100° C. and subsequently air cooling the shell components at a rate greater than 25° C./minute to harden the shell components to a Rockwell C hardness of at least 39; and affixing the shell components together to form a tank.

14. The method of manufacturing a tank of claim 13 wherein said steps of stamping and hardening the steel blanks are performed simultaneously in a hot stamping operation.

15. The method of manufacturing a tank of claim 13 further comprising the steps of:

allowing the shell components to reach equilibrium after hardening;

tempering the shell components by heating the shell components to between 150° C. and 650° C.; and allowing the shell components to air cool after tempering to ambient temperatures.

16. The method of manufacturing a tank of claim 13 further comprising the steps of:

allowing the shell components to reach equilibrium after hardening;

performing a low temperature tempering of the shell components by heating the shell components to between 130° C. and 180° C.; and allowing the shell components to air cool after tempering to ambient temperatures.

17. The method of manufacturing a tank of claim 16 wherein the step of performing a low temperature tempering is accomplished during an electro-coating bake cycle.

18. The method of manufacturing a tank of claim 16 further comprising the step of affixing a sub-component to a shell component, said step of affixing a sub-component to a shell component being done prior to said step of performing a low temperature tempering of the shell components.

19. The method of manufacturing a tank of claim 16 wherein said step of performing a low temperature tempering is accomplished after said step of affixing the shell components together to form a tank.

20. The method of manufacturing a tank of claim 18 wherein the sub-component is selected from the group consisting of pumps, one-way valves, fuel level sensors, baffles, temperature sensors and pressure sensors.

21. The method of manufacturing a tank of claim 13 wherein the air hardenable martensitic stainless steel blanks are type 410 or type 420.

22. The method of manufacturing a tank of claim 13 wherein the air hardenable martensitic stainless steel blanks have a thickness of 0.8 to 2.0 mm. and the tank is an automotive fuel tank.

23. The method of manufacturing a tank of claim 13 wherein said step of affixing the shell components together to form a tank includes the steps of:

welding a first shell component to a second shell component by applying a first heat source to the first shell component and the second shell component at a sufficiently high temperature to bring surfaces of first shell component and the second shell component above their melting points to form a weld; and applying a second heat source at the weld immediately after the step of welding so as to be prior to the weld cooling below the lower critical temperature for the martensitic stainless steels, the second heat source being at a temperature lower than the first heat source but at a sufficiently high temperature and maintained for sufficient long time period so as to reduce the hardness of the weld.

* * * * *